US005747108A

United States Patent [19]

Farooq et al.

[11] Patent Number: 5,747,108

[45] Date of Patent: May 5, 1998

[54] SUPER-CONCENTRATED LIQUID RINSE CYCLE FABRIC SOFTENING COMPOSITION

[75] Inventors: Amjad Farooq, Somerset; Jeffrey Joseph Mastrull, Middlesex, both of N.J.

[73] Assignee: Colgate-Palmolive Co., New York, N.Y.

[21] Appl. No.: 818,694

[22] Filed: Mar. 19, 1997

[51] Int. Cl.[6] ..... B05D 3/12

[52] U.S. Cl. ..... 427/242; 510/504; 510/515; 512/26

[58] Field of Search ..... 510/504, 515; 427/242; 512/26

[56] References Cited

U.S. PATENT DOCUMENTS

| | | | |
|---|---|---|---|
| 4,724,089 | 2/1988 | Konig et al. | 252/8.8 |
| 5,108,628 | 4/1992 | Uphues et al. | 252/8.6 |
| 5,133,885 | 7/1992 | Contor et al. | 252/8.6 |
| 5,154,838 | 10/1992 | Yamamura et al. | 252/8.6 |
| 5,180,508 | 1/1993 | Birkhan et al. | 252/8.8 |
| 5,468,398 | 11/1995 | Farooq et al. | 252/8.8 |
| 5,476,598 | 12/1995 | Schramm et al. | 252/8.8 |
| 5,501,806 | 3/1996 | Farooq et al. | 252/8.8 |
| 5,652,206 | 7/1997 | Bacon et al. | 510/101 |
| 5,668,102 | 9/1997 | Severns et al. | 510/107 X |

FOREIGN PATENT DOCUMENTS

| | | |
|---|---|---|
| 0038862 | 4/1981 | European Pat. Off. . |
| 0295386 | 6/1987 | European Pat. Off. . |

*Primary Examiner*—Michael Lusignan

*Attorney, Agent, or Firm*—Bernard Lieberman; James M. Serafino

[57] ABSTRACT

Super-concentrated liquid rinse cycle fabric softeners are provided which contain more than 35%, by weight, of a fabric softening system based on an amidoamine fabric softener, such as bis(tallow amidoethyl)-2-hydroxyethyl amine and a quaternary diester fabric softener, such as N-methyl, N,N,N-triethanolamine ditallow ester quaternary ammonium salt. A fatty alcohol ethoxylate surfactant and a polyethylene glycol polymer or a polyethylene glycol alkyl ether polymer are integral components of the liquid composition. The super-concentrated compositions may be used at low levels or may be further diluted prior to use.

11 Claims, No Drawings

SUPER-CONCENTRATED LIQUID RINSE CYCLE FABRIC SOFTENING COMPOSITION

FIELD OF INVENTION

This invention relates to liquid fabric softening compositions. More particularly, the invention relates to super concentrated liquid fabric softening compositions which are effective in softening fabrics in both soft and hard water and which are primarily intended as rinse cycle fabric softening compositions as undiluted concentrates for ready-for-use products at reduced dosage or as products which are diluted before use with water for use at the same dosage levels as the conventional ready-for-use products.

BACKGROUND OF THE INVENTION

Compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g., biodegradability) of the quaternary compound softeners, as well as limits in the amounts of these cationic compounds which can be stably incorporated into the more convenient to use liquid formulations, there have been many proposals for partial or total replacements of the conventional "quat" fabric softeners which are exemplified by dimethyl distearyl (or ditallow) ammonium chloride and various imidazolinium compounds.

For instance in GB 2,032,479A, corresponding to EP 038862, to D. Fontanesi (assigned to Albright & Wilson Ltd.) water dispersible unquaternized hydroxyalkyl diamidoamine compounds of formula $$RNH((CH_2)_nNR)_mR$$

wherein an average of from 20% to 80% of the R groups are $C_{12}$ to $C_{22}$ acyl, at least 20% of the R groups are $—CH_2CH_2OH$ or $—CH_2CHOHCH_3$ or mixtures of these groups, and any other R group is hydrogen, n is 2 or 3 and m is an integer of from 2 to 5, are provided as mobile pastes in the presence of lower alkanol solvents. This is stated to be in contrast to partially neutralized unquaternized diamidoamines which, while providing highly effective fabric softening properties, are too viscous even when diluted in the lower alkanol solvents for convenient handling.

U.S. Pat. No. 5,154,838 (corresponding to EP 0459211A2) to Yomamura, et al. (assigned to Kao Corp.) discloses an aqueous liquid softener composition based on an amidoamine compound which is the condensation reaction product of a di- or tri-amine of formula (I):

$$R^1NH(C_mH_{2m}NH)_nH \qquad (I)$$

with a fatty acid of formula (II):

$$R^2\underset{\underset{O}{\|}}{C}—OH \qquad (II)$$

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amidoamine compound is used in the form of its neutral salt.

U.S. Pat. No. 5,108,628 to Uphues, et al. (Henkel) discloses certain aliphatic carboxylic acid amidoamines which are obtained by reaction of polyamines (e.g., diethylentriamine, aminoethyl ethanolamine) with carboxylic acid mixtures containing ether carboxylic acids ($R—O—(CH_2CH_2O)_n—CH_2COOH$, $R=C_{8-18}$ alkyl, $C_{8-18}$ alkenyl or $CH_2—COOH$, n=2 to 20, in combination with aliphatic C8-22 monocarboxylic acids and/or amide-forming aliphatic $C_{8-22}$ monocarboxylic acid derivatives) as fabric softeners stable in the presence of electrolytes.

In U.S. Pat. No. 5,133,885 to L. Contor, et al. (corresponding to EP 0423894, both assigned to Colgate-Palmolive Company, the assignee of the present invention) fabric softening compositions are described which are aqueous dispersions of a fatty acid ester quat of formula:

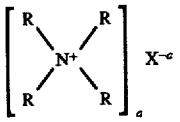

where one or two R groups represent an aliphatic ester residue of from 12 to 30 carbon atoms of formula $C_nH_{2n}OCOR_4$, and the remaining R groups represent lower aliphatic, aryl or hydroxyalkyl groups, $X^-$ is an anion and "a" represents the ionic valence of the anion, and a fatty acid amidoamine softener of formula:

$$R^1CONH(CH_2)_m\underset{\underset{R^2}{|}}{N}—R^3$$

where $R^1$ is a $C_{12}$ to $C_{30}$ alkyl or alkenyl group, $R^2$ represents $R^1$, $R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amidoamine of from 10:1 to 1:10. This patent discloses total amounts of esterquat and amidoamine ranging from 3% to 60% by weight, however, compositions containing at most 8% by weight of active softeners are disclosed.

U.S. Pat. No. 5,180,508 to Birkhan, et al. (corresponding to EP 0413249, assigned to REWO Chemische) discloses aqueous fabric softener rinsing agents based upon a mixture of quaternary salt compounds: a first component (a) of formula (I)

$$[(R^2—\overset{\overset{(R^3)_x}{|}}{N}—(CH_2\overset{\overset{R}{|}}{C}H—OR^1)_{3-n}]_g^{m+}mA^{-z} \qquad (I)$$

wherein, each R is independently hydrogen or lower alkyl;

each $R^1$ is hydrogen or an alkylcarbonyl group containing 15–23 carbon atoms, provided that at least one of $R^1$ is an alkylcarbonyl group;

each $R^3$ is an alkyl group containing 1–4 carbon atoms which is unsubstituted or substituted with 1, 2, or 3 hydroxy groups;

each $R^2$ is an alkyl group containing 1–4 carbon atoms which may be unsubstituted or substituted with 1, 2, or 3 hydroxy groups, or is a group of the formula:

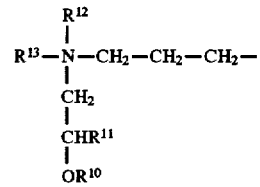

(II)

$R^{13}$ is an alkyl group containing 8–22 carbon atoms; $R^{12}$ is an alkyl group containing 1–4 carbon atoms which is unsubstituted or substituted with 1, 2, or 3 hydroxy groups;

$R^{11}$ is hydrogen or lower alkyl;

$R^{10}$ is hydrogen or alkylcarbonyl group containing 14–22 carbon atoms;

A is an anion of a quaternizing agent;

n is 0 or 1;

x and y are independently 0 or 1 with the proviso hat (x+y)+(3−n)=4; and m is 1 or 2; and g is 1, 2 or 3, such that (m/g) (g)=m, and a second component (b) which is a quaternary salt of an imidazolinium compound (III), an amidoamine compound (IV), an 5 ammonium compound (V), or diimidazolinium compound (VI). The amidoamine amine compound has the formula:

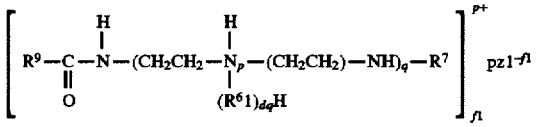

(IV)

wherein $R^6{}_1$ is CHX—CHY—O;

X and Y are independently hydrogen or lower alkyl (but not both alkyl);

$R^7$ is an alkylcarbonyl group containing 4–22 carbon atoms or H;

$R^9$ is an alkyl group containing 14–22 carbon atoms;

$Z_1$ is a water-soluble monobasic or polybasic anion;

d and $d_1$ are independently 0–6; q is 0 or 1; $f_1$ is 1, 2 or 3; p is 1–3; and p+q$^3$2.

The mixture of the soft-rinsing agent (a) and (b) constitutes from 10 to 25% by weight of the composition at ratios of (a):(b) of from 1:9 to 9:1. The alkyl groups in $R^7$ and $R^9$ are preferably completely saturated. Viscosity control agents, including electrolyte salts, e.g., calcium chloride, may be included.

U.S. Pat. No. 4,724,089 to König, et al. discloses aqueous dispersions of certain amines, including reaction products of higher fatty acids with a polyamine (e.g.,

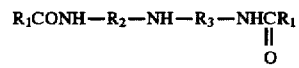

where $R_1$=acyclic aliphatic $C_{15}$–$C_{21}$ hydrocarbon; $R_2$ and $R_3$=divalent $C_1$–$C_3$ alkylene groups) with a dispersing aid (e.g., HCl) and, optionally, quaternary ammonium salt (e.g., diamido (alkoxylated) quaternary ammonium salts). Relatively small amounts of electrolyte, e.g., $CaCl_2$, can be added to adjust viscosity.

EP 0295,386 to Ruback, et al. discloses a free-flowing softening washing rinse concentrate containing (a) from 18 to 50 weight percent of a mixture of at least two quaternary ammonium salts: (A) 10–90 wt % of triethanol-amine ester quaternary ammonium compound, and (B) 90 to 10 wt % of another quaternary compound including quaterized amidoamine (or equivalent esteramine or thioamine) and (b) water and optional conventional additives.

While these and many other proposals are known for improved fabric softening compositions, nevertheless, still further improvements are desired.

One such proposal is described by Schramm, et al. in U.S. Pat. No. 5,476,598. According to this proposal stable, aqueous, pourable and water dispersible, fabric softener compositions are provided which include (A) a fabric softening effective amount of an inorganic or organic acid salt of a finely divided softening compound of formula (I):

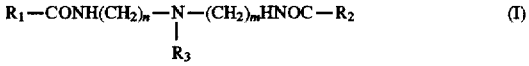

(I)

wherein $R_1$ and $R_2$, independently, represent $C_{12}$ to $C_{20}$ alkyl or alkenyl; $R_3$ represents $(CH_2CH_2O)_pH$, $CH_3$ or H; n and m are each a number of from 1 to 5; and p is a number of from 1 to 10; (B) a stabilizing amount of a defined emulsifier-dispersing agent; and (C) an aqueous solvent. The compositions are provided as ready-to-use products or as concentrates to be used at reduced levels or which may be diluted with water prior to use at the same or similar levels as the ready-to-use products. In the ready-to-use composition the total amount of amidoamine softener (A) and stabilizing dispersant (B) is disclosed to fall in the range of from about 2 to 8% by weight. In the concentrated form the total amount of (A) and (B) is generally in the range of from about 12 to 60% and may be diluted at ratios of water:concentrate as high as about 4:1 to even 8:1 or 9:1, and still provide acceptable softening performance, equivalent or better than that achieved using conventional quaternary cationic surfactant softeners, such as dimethyl distearyl ammonium chloride (DMDSAC).

An alternative embodiment of the Schramm, Jr., et al. fabric softener aqueous liquid compositions which is adaptable for use in the rinse cycle of a laundering process and which is described as stable, pourable, and dispersible in water, includes the following ingredients:

(A') an inorganic or organic acid salt of bis(hydrogenated tallow amidoethyl) hydroxyethyl amine, (B') an inorganic or organic acid salt of bis(non-hydrogenated tallow amidoethyl) hydroxyethyl amine, with the total amount of (A') and (B') being from about 2% to about 50% by weight of the composition, and the ratio by weight of (A') to (B') being in the range of from about 10:1 to abut 1.5:1, and an aqueous solvent.

The compositions disclosed in the aforesaid U.S. Pat. No. 5,476,598 to Schramm et al. provide highly effective stable and pourable liquid fabric softener compositions; nevertheless, in practice it is found that with concentrations of the amidoamine fabric softening compound (e.g. Varisoft 510) in excess of 11 weight percent in the presence of certain emulsifiers, such as hydrogenated tallow, the product viscosity becomes excessively high, even in the presence of electrolytes (e.g. $CaCl_2$) or solvents (e.g. propanol). While higher total concentrations of the amidoamine were achieved using the soft tallow product Varisoft 512 or mixtures of Varisoft 512 and hard tallow product, Varisoft 510, the softening performance of the Varisoft 512 containing compositions, was not sufficiently improved.

The prior art has focused attention on ways to increase the concentration in the liquid fabric softening composition of the amidoamine softener compound Varisoft 510 in view of its very good environmental attributes and favorable acute toxicity data as well as its strong softening performance.

However, as noted above, at high concentrations the viscosity increases substantially until gelation occurs.

It was recently discovered that the incorporation of cyclic imidazolinium compounds can increase the concentratability of fatty amido tertiary amine softeners and also significantly improve the softening efficacy of Varisoft 15 510. This discovery is described in greater detail U.S. Pat. No. 5,468,398 to Farooq et al. According to this patent a stable, pourable, water dispersible aqueous liquid fabric softener composition includes:

(A) a softening effective amount of an inorganic or organic acid salt of a finely divided fatty amido tertiary amine compound of formula (I):

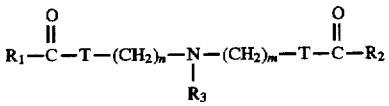

(I)

wherein $R_1$ and $R_2$, independently, represent $C_{12}$ to C20 alkyl or alkenyl; $R_3$ represents $(CH_2CH_2O)_pH$, $CH_3$ or H; T represents O or NH; n and m are each, independently, a number of 1 to 5; and p is a number of from 1 to 10; (B) a viscosity controlling and softening improving effective amount of a defined cyclic imidazolinium compound; and (C) an aqueous solvent including an anti-gelling effective amount of electrolyte. Compositions containing up to 25 wt % of active ingredients (A) and (B) are exemplified, with amounts of (A) and (B) up to 60% being disclosed.

In an effort to provide concentrated liquid fabric softening compositions containing more than 25%, by weight, of a softening system based on amido amine and a diesterquaternary compound, there is described in U.S. Pat. No. 5,501,806 to Farooq et al. a concentrated softening composition characterized by hydrocarbon groups in the defined softening compounds which have a specified degree of unsaturation to create a stable and efficacious softening composition. The two active softening compounds in the compositions are stated to comprise from about 25% to about 50%, by weight, of the softening composition. While the softening compositions of Farooq et al. provide high concentrations of softening compounds which are shown in the Examples to be effective softeners, there, nevertheless, appears to be a practical upper limit of concentration of about 35%, by weight, as governed by the effect of concentration on viscosity. Specifically, Table 3 of this Farooq et al. patent provides data which indicates that for compositions containing amidoamine/esterquat softening actives above 35%, by weight, gelation of the composition is likely to occur.

Accordingly, notwithstanding the various improvements described in the patent literature in formulating concentrated liquid fabric softening compositions, still further improvements are required to provide rinse cycle softening compositions containing more than 35%, by weight, of a softening system based on amido amine and diester quaternary compounds with respect to one or more of the following properties: low viscosity (e.g., below about 2,000 cP at 20° C. and preferably below about 1,500 cP), stability against phase separation for extended periods, stability against increasing viscosity over extended periods, improved softening performance and rapid dispersibility of the composition when added to water, including cold, warm or hot rinse water. Furthermore, it is desired to achieve these higher concentrations (to reduce packaging costs, etc.) in still pourable liquid compositions without requiring high pressure homogenization. Still another important consideration is the softening performance of the composition in hard water as well as soft water.

Accordingly, it is an object of this invention to provide low viscosity, stable and flowable aqueous dispersions containing high concentrations of environmentally acceptable fabric softeners to provide enhanced softening performance.

Another object of the invention is to provide such low viscosity, stable and flowable aqueous dispersions with nitrogen compound fabric softeners in amounts of at least 35 percent by weight of the composition and which are suitable for use with or without further dilution to provide softening performance at least equivalent to that obtainable with present commercially available rinse cycle fabric softeners.

SUMMARY OF THE INVENTION

The above and other objects of the invention which will become more apparent from the following detailed description and examples, has been achieved by a concentrated, stable, pourable, and water-dispersible liquid fabric softener composition containing a perfume and having a viscosity of less than about 2,000 centipoise at 20° C. comprising an aqueous dispersion containing (a) more than 35%, by weight, of a combination of softening components (A) and (B) wherein (A) is an inorganic or organic acid salt of a fabric softening compound of formula (I):

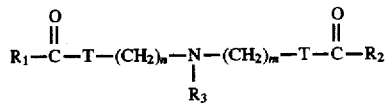

(I)

wherein $R_1$ and $R_2$ independently represent $C_{12}$ to $C_{30}$ aliphatic hydrocarbon groups,
$R_3$ represents $(CH_2CH_2O)_pH$, $CH_3$ or H,
T represents NH,
n=1 to 5,
m=1 to 5, and
p=1 to 10; and (B) is a biodegradable fatty ester quaternary ammonium compound of formula (II):

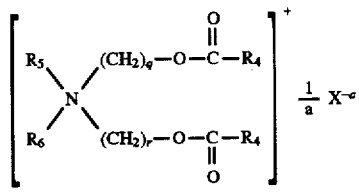

(II)

wherein each $R_4$ independently represents an aliphatic hydrocarbon group having from 8 to 22 carbon atoms, $R_5$ represents $(CH_2)_s R_7$ where $R_7$ represents an alkoxy carbonyl group containing from 8 to 22 carbon atoms, benzyl, phenyl, $(C_1-C_4)$—alkyl substituted phenyl, OH or H; $R_6$ represents $(CH_2)_t R_8$ where $R_8$ represents benzyl, phenyl, $(C_1-C_4)$ alkyl substituted phenyl, OH or H; q, r, s and t, each independently, represent a number of from 1 to 3; and x is an anion of valence a; the weight ratio of component (A) to component (B) being from about 5:1 to about 1:5, and with the proviso that at least 15% of hydrocarbon groups containing two or more carbon atoms in components (A) and (B) combined contain at least one unsaturated carbon to carbon bond;

(b) an aqueous solvent including an anti-gelling effective amount of electrolyte;

(c) a fatty alcohol ethoxylate in an amount sufficient to emulsify the perfume in the composition; and (d) an effective amount of a polyethylene glycol polymer or a polyethylene glycol alkyl ether polymer having a molecular weight of at least 200, said effective amount being sufficient to prevent gelation of the composition.

The present invention also provides a method of imparting softness to fabrics by contacting the fabrics with a softening effective amount of the invention fabric softener composition; generally and preferably, in the rinse cycle of an automatic laundry washing machine. The compositions may be diluted with water prior to adding the composition to the washing machine (e.g., the rinse cycle dispenser), or may be added, at reduced amount, without dilution, i.e., ready to use.

In accordance with another aspect of the invention there is provided a method of preparing a concentrated stable, pourable and water-dispersible liquid fabric softening composition containing a perfume and having a viscosity of less than about 2,000 centipoise at 20° C., wherein the composition contains (a) more than 35%, by weight, of softening components (A) and (B) as described above in formulas I and II, respectively, and further containing (b) a fatty alcohol ethoxylate;

(c) an anti-gelling effective amount of electrolyte; and (d) an anti-gelling additive comprising a polyethylene glycol polymer or a polyethylene glycol alkyl ether polymer having a molecular weight of at least 200, the method comprising the steps of:

(1) preparing an oil phase portion comprising component (A) and component (B), component (A) being in the form of a protonated or a non-protonated amine;

(2) preparing a water phase portion comprising an aqueous solution of the polyethylene glycol polymer with the proviso that when component (A) is present in the oil phase portion in the form of a non-protonated amine, the water phase portion further contains an inorganic or organic acid capable of protonating component (A);

(3) heating said oil phase portion to a temperature above about 60° C. and then mixing same with the water phase portion to form a gel or thick emulsion;

(4) preparing an aqueous solution of said electrolyte and adding same with agitation to the gel or emulsion formed in step (3) to form a thin pourable emulsion;

(5) preparing an aqueous slurry comprising an emulsifying amount of the fatty alcohol ethoxylate and said perfume; and (6) adding the slurry of step (5) under agitation to the emulsion of step (4) at a temperature above about 35° C. to provide a concentrated, stable and readily pourable perfume-containing softening composition.

The level of unsaturation of the hydrocarbon groups in components (A) and (B) is a critical feature of the invention. To achieve a highly concentrated pourable liquid fabric softening composition in accordance with the invention, at least 15% of the hydrocarbon groups in component (A) and (B) combined must not be fully saturated, preferably at least 20% of such hyrdocarbon groups. In preferred embodiments, the percentage of unsaturated groups in the softening components will vary from about 20 to about 60, especially from about 20 to about 40.

DETAILED DESCRIPTION AND PREFERRED EMBODIMENTS

The present invention was developed as part of an extensive research program to evaluate available fabric softening compounds which do not pose the risk of, or at least reduce the risk of, causing environmental damage associated with conventional cationic quat fabric softeners, such as dimethyl distearyl ammonium chloride (DMDSAC) yet which offer equivalent or superior softening performance to DMDSAC and which are amenable for use in concentrated products. The latter requirement is important in view of the trend in the industry to sell concentrated products which require less packaging and lower shipping costs on a per unit or per usage basis and, therefore, can be characterized as environmentally and user friendly.

As a result of this extensive research it was found that the class of amidoamines, and particularly fatty amidotertiary amines and corresponding esters of the foregoing formula (I), and which are commercially available, for example, under the Varisoft trademark from Witco Chemical Company, when provided in the form of its acid (protonated) complex, met the objectives of high efficacy softening performance and environmental acceptability.

Although not wishing to be bound by any particular theory of operation it is believed that the good softening performance is due to the excellent inherent dispersibility of the finely divided amidoamine softener when the compound is protonated as its acid complex. Such excellent inherent dispersibility is believed to result from the presence of the diamido amine hydrophilic group, which may be further enhanced by a moderate level of ethoxylation (e.g., when $R_3$ represents $(CH_2CH_2O)_pH$). On the other hand, the presence of the two long chain hydrocarbon groups ($C_8$–$C_{20}$ alkyl or alkenyl) contribute to effective fabric softening.

However, the concentratability of the fatty tertiary amido amine fabric softeners of formula (I) was found to be limited to no more than about 11% by weight before gelation occurs or otherwise unacceptably high viscosity results. It is presumed that this phenomenon is the result of the crystallinity of fatty tertiary amine, that is, the formation of a liquid crystalline phase. In general, the viscosity increase in concentrated samples and over time is believed to be associated with the formation of multilayered vesicle structures which trap increasing amounts of water and thereby cause the composition to exhibit an increase in viscosity. In other words, the phase volume of the composition increases with increasing softener concentration and time while the continuous (aqueous) phase gradually decreases with time.

As described in the aforementioned Schramm, Jr. et al., U.S. Pat. No. 5,476,598, it has been observed that Varisoft 512 (soft tallow tertiary amine) is capable of reducing the crystallinity of, and concentratability of Varisoft 510 (hydrogenated (hard) tallow tertiary amine) but with relatively poorer softening performance. In any case, the softening performance of the tertiary amine compound containing higher aliphatic amide or ester groups containing unsaturation (carbon to carbon double bonds), e.g., soft tallow amide, etc., is generally significantly poorer than the corresponding compounds which are fully saturated, e.g., hydrogenated tallow amide.

While it has been known in the past that stability against phase separation of aqueous dispersions of finely divided substances, including fabric softening or other fabric treating agents, may be improved by incorporating certain dispersing aides, co-surfactants, emulsifiers, and the like, into the aqueous dispersions, the art has not provided any general guidelines or principles for determining which of the myriad possible candidate compounds would be able to provide the desired improvement in stability and reduction in viscosity, much less improvement in softening performance.

It had been previously reported by Farooq et al. in U.S. Pat. No. 5,501,806 that the fatty ester quaternary ammonium compound of formula (II), when added to an aqueous dispersion of the fatty amide (or ester) tertiary amine compound fabric softener of the formula (I) containing a significant level of unsaturation creates a stable, pourable, efficacious softening composition. This was contrary to previous general beliefs in the art, that efficacious softening could not be obtained from unsaturated alkyl group containing softening compounds.

The mixture of the compounds of formulas (I) and (II) allow the compositions to be formulated as concentrates for subsequent dilution (if desired) at ratios as high as 8:1 or higher, while still remaining pourable in the concentrated form. These same concentrated formulas may, of course, be used without dilution but in smaller quantities to achieve superior softening performance.

Thus, the compositions of this invention are stable, pourable, and rapidly water dispersible aqueous dispersions which contain, (A) a fabric softening effective amount of an inorganic or organic acid salt of fatty amido (or ester) tertiary amine of formula (I), with a significant level of unsaturated bonds, and (B) a synergistic viscosity reducing and fabric softening ester quaternary ammonium compound of formula (II), wherein the total amount of (A) and (B), combined is from about 35% to about 50% by weight, especially from more than 35% to about 40% by weight. The aqueous dispersion within these amounts of fabric softening active ingredients is of low viscosity, namely, remains pourable at ambient temperature, particularly less than 1500 cP at 20° C.

The fabric softening active compound (A) is an amido (or ester) tertiary amine of formula (I):

$$R_1-\overset{\overset{\displaystyle O}{\|}}{C}-T-(CH_2)_n-\underset{\underset{\displaystyle R_3}{|}}{N}-(CH_2)_m-T-\overset{\overset{\displaystyle O}{\|}}{C}-R_2 \qquad (I)$$

In the above formula $R_1$ and $R_2$ are each, independently, long chain aliphatic hydrocarbons, e.g., alkyl or alkenyl groups having from 12 to 30 carbon atoms, preferably from 16 to 22 carbon atoms. Linear hydrocarbon groups, such as, for example, dodecyl, dodecenyl, octadecyl, octadecenyl, behenyl, eicosyl, etc., are preferred. Typically, $R_1$ and $R_2$, and more generally $R_1$—CO— and $R_2$—CO, will be derived from natural oils containing fatty acids or fatty acid mixtures, such as coconut oil, palm oil, tallow, rape oil, and fish oil. Chemically synthesized fatty acids are also usable. Generally and preferably $R_1$ and $R_2$ are derived from the same fatty acid or fatty acid mixture. According to this invention, it has been discovered that when $R_1$ and $R_2$ are derived from or contain up to about 80%, but preferably not more than 65% by weight of unsaturated (i.e., alkenyl) groups, the relatively poor softening performance of unsaturated moieties of the compound of formula (I) is overcome by the combination with the ester quat compound (B) of formula (II) and an effective amount of a viscosity reducing electrolyte.

$R_3$ in formula (I) represents $(CH_2CH_2O)_pH$, $CH_3$, or H, or mixtures thereof. When $R_3$ represents the preferred $(CH_2CH_2O)_pH$ group, p is a positive number representing the average degree of ethoxylation, and is preferably from 1 to 10, especially 1.4 to 6, and more preferably from about 1.5 to 4, and most preferably, from 1.5 to 3.0. n and m are integers of from 1 to 5, preferably 1 to 3, especially 2. The compounds of formula (I) in which $R_3$ represents the preferred $(CH_2CH_2O)_pH$ group are broadly referred to herein as ethoxylated amidoamines (when T—NH) or ethoxylated ester amines (when T=O), and the term "hydroxyethyl", is also used to describe the $(CH_2CH_2O)_pH$ group.

Most especially preferred is the compound of formula (I) which is commercially available under the tradenames Varisoft 512 (a 90% concentration with a 10% organic solvent), or Varisoft 511 (approximately a 100% active ingredient concentration), available from Witco Chemical Company, which is bis(tallow-amidoethyl)-hydroxyethyl amine of formula $$((\text{Tallow})-\overset{\overset{\displaystyle O}{\|}}{C}-NH-CH_2CH_2)_2-N-(CH_2CH_2O)_xH$$
$$(X = 1.5 \text{ to } 3.0)$$

In place of a portion of Varisoft 512 or 511, the corresponding hydrogenated tallow amidoamine derivative, available from Witco under the tradename Varisoft 510:

$$(\text{H-Tallow})-\overset{\overset{\displaystyle O}{\|}}{C}NH-(CH_2)_n-\underset{\underset{\displaystyle (CH_2CH_2O)_xH}{|}}{N}-(CH_2)_m-\overset{\overset{\displaystyle O}{\|}}{C}NH-(\text{H-Tallow})$$

may be used.

When mixtures of hydrogenated and non-hydrogenated softener compounds are used the percentage of alkenyl groups is based on the total of both compounds. For example, in the case of Varisoft 512 which is derived from a natural (beef) tallow (often referred to as "soft-tallow" or sometimes, simply as "tallow" or AA(S)) the average fatty chain composition is typically (variations occur depending on the particular source, time of year, feed supply, etc.):

$C_{14}$=5% including 1% of mono-unsaturated chains (alkyl chains containing one carbon to carbon double bond, i.e. alkenyl)

$C_{16}$=30% including 4% of mono-unsaturated chains $C_{18}$=65% including 39% of mono-unsaturated chains and 1% di-unsaturated chains.

Therefore, in soft-tallow there is about 45% of unsaturated alkyl chains and 55% of saturated alkyl chains. Conversely, in hydrogenated tallow (also sometimes referred to as "hard tallow" or "H-tallow" or AA(H)) all of the unsaturated chains are converted to saturated chains. Therefore, H-tallow contains about 100% of saturated chains.

Accordingly, for mixtures of Varisoft 512 or 511, and Varisoft 510, the amount of Varisoft 512 or 511 should be at least about 25% of the mixture to provide at least about 11% by weight of unsaturated chains within the overall amidoamine component.

While the long chains ($R_1$ and $R_2$) of the formula (I) compounds may, theoretically, be entirely unsaturated, in practice the softening performance of such unsaturated compounds is not sufficient. Therefore, it is preferred to limit the amount of the unsaturated chains to no more than about 80%, preferably no more than about 65%, by weight based on the total of the $R_1$ and $R_2$ groups.

Since Varisoft 512 and Varisoft 511 both contain about 45% of unsaturated long chain alkyl groups, either of these amidoamine fabric softeners may be used by itself. However, to achieve still higher softening performance, while maximizing the total amount of fabric softening active ingredients [(A) and (B) combined] it is preferred to maintain the unsaturated alkyl chains at below about 36% by weight, especially below about 30% by weight, based on the total of the higher alkyl groups ($R_1$ and $R_2$) in the formula (I) compounds.

Therefore, for the preferred mixtures of Varisoft 510 and Varisoft 512 the ratio of the hard-tallow (510) to soft tallow (512) compounds is in the range of from about 20 to 60:80 to 40, more preferably from about 45 to 55:65 to 45; such as, for example, 55:45 (corresponding to about 20% by weight of unsaturated chains). The additional unsaturation contributed to the overall formulation by the addition of a quaternized ammonium ester, discussed below, may effect the proportionate amount of unsaturation required from the AA(S) component (Varisoft 512) herein discussed.

In the non-neutralized (non-protonated) form the fatty amide or fatty ester tertiary amine compounds are hardly or not at all dispersible in water. Therefore, in the present invention, the amine function of the amidoamine or ester amine compound is at least partially neutralized by a proton contributed by a dissociable acid, which may be inorganic, e.g., HCl, $H_2SO_4$, $HNO_3$, etc. or organic, e.g. acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid used will depend on the "strength" of the acid; strong acids such as HCl, and $H_2SO_4$ completely dissociate in water, and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least an 0.5:1 molar ratio, and up to about a 1:1 molar ratio of the acid to the total amount of fabric softener fatty amide or ester tertiary amine. For the organic carboxylic acids, however, it is preferred to use a molar excess of the neutralizing acid. Molar ratios of organic carboxylic acid to the compound of formula (I) up to about 6:1, for example from 1.5:1 to 6:1, such as 2:1, 3:1 or 4:1, have been found advantageous in terms of stability and/or softening performance. The use of glycolic in molar excess is especially preferred.

However, it has also been found that partially neutralized ethoxylated fatty amide or fatty ester tertiary amines are highly stable. Therefore, in some cases molar ratios of acid (as HCl) to ethoxylated amine (or ester) of formula (I) of from 0.5:1 to about 0.95:1, such as 0.6:1 and 0.7:1, can be advantageously used. For the mineral acids, such as HCl, molar ratios above 1:1 should generally be avoided since, otherwise, a gel may form.

The second essential fabric softener compound according to this invention is the biodegradable quaternized ammonium ester compound (B) of the following formula (II)

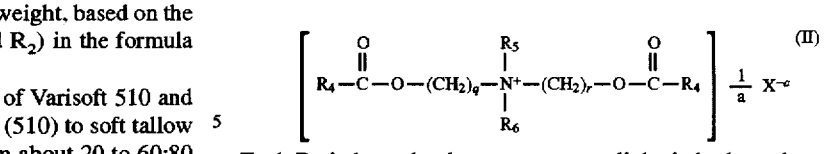

(II)

Each $R_4$ independently represents an aliphatic hydrocarbon group having from 8 to 22 carbon atoms, and preferably 14 to 18 carbon atoms. $R_5$ represents the group $(CH_2)_s$—$R_7$ which, depending on $R_7$, may represent a long chain alkyl ester group ($R_7$=$C_8$–$C_{22}$ alkoxy carbonyl), in which case the compounds of formula (III) are triester quaternary ammonium compounds.

Preferably, however, the fatty ester quaternary compounds are diester compounds, i.e. $R_7$ represents benzyl, phenyl, phenyl substituted by $C_1$–$C_4$ alkyl, hydroxyl (OH) or hydrogen (H). Most preferably $R_7$ represent OH or H, especially preferably OH, e.g. $R_5$ is hydroxyethyl.

q, r and s, each, independently, represents a number of from 1 to 3.

X represents a counter ion of valence a. For example, the diester quat of formula (III) may be a compound of the formula:

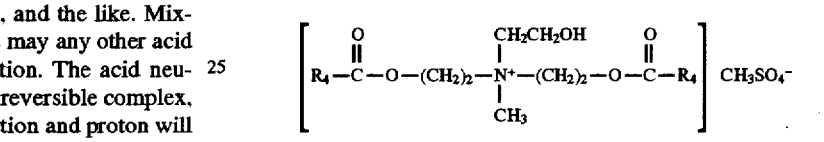

where each $R_4$ may be, for example, derived from hard or soft tallow, coco, stearyl, oleyl, and the like. Such compounds are commercially available, for example, Tetranyl AT-75, from Kao Corp. Japan, which is di-tallow ester triethanol amine quaternary ammonium methyl sulfate. Tetranyl AT-75 is based on a mixture of about 25% hard tallow and about 75% soft tallow. Accordingly, this product contains about 34% of unsaturated alkyl chains. A second example would be Hipochem X-89107, from High Point Chemical Corp.; which is an analogue of the Tetranyl AT-75 with about 100% saturation in the tallow moieties. However, in general the quaternized ammonium ester compound of formula (III) may contain from about 5% to about 75% of unsaturated (long-chain) alkyl groups.

The compounds (A) of formula (I) and compounds (B) of formula (II) are used in admixture, preferably at ratios of about 5:1 to about 1:5, more preferably from 2:1 to 1:2, especially 1.7:1 to 1:1.7, whereby both softening performance and stability and pourability are improved. That is, notwithstanding the poor softening performance of the unsaturated long-chain alkyl compounds when used individually, when used with the ester quat compound (which also preferably contains carbon to carbon double bonds) either alone or in combination with the hydrogenated amido amine compound a surprisingly substantial improvement in softening performance is observed in pourable liquid formulations.

The total amounts of components (A) and (B) is from above 35 to about 50 wt. percent, preferably from above 35 to about 40 wt %, and the ratio, by weight of (A):(B) is from about 2:1 to 1:2, and especially, from about 1.7:1 to 1:1.

The compositions of this invention are provided as aqueous dispersions in which the fabric softener compounds of formula (I) and formula (II) are present in finely divided form stably dispersed in the aqueous phase. Generally, particle sizes of the dispersed particles of less than about 25 microns (μm), preferably less than 20 μm, especially preferably no more than 10 μm, on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 μm, preferably at least about 0.05 μm. A preferred particle size range of the dispersed softener ingredients is from about 0.1 to about 8 μm.

However, one of the advantageous features of the compositions of this invention is that it is not necessary to subject the composition to high shear conditions, such as by high pressure homogenization. Simple mixing of the ingredients in water with a low shear mixer provides stable dispersions of finely divided particles.

The aqueous phase of the dispersion is primarily water, usually deionized or distilled water. Small amounts (e.g. up to about 5% by weight) of co-solvent may be present for adjustment of viscosity. Typically, as the co-solvent lower mono- and poly-hydroxy alcohols and aqueous will be used, generally in amounts up to about 8% by weight of the composition. The preferred alcohols and aqueous are those having from 2 to 4 carbon atoms, such as, for example, ethanol, propanol, isopropanol, and propylene glycol or ethylene glycol. Isopropyl alcohol (2-propanol) is especially preferred. However, co-solvents are not required and are generally avoided.

The compositions of this invention include an electrolyte to reduce dispersion viscosity. Generally, any of the alkaline metals or alkaline earth metal salts of the mineral acids can be used as electrolyte. In view of availability, solubility and low toxicity, NaCl, $CaCl_2$, $MgCl_2$ and $MgSO_4$ and similar salts of alkaline and alkaline earth metals are preferred, and $CaCl_2$ is especially preferred. The amount of the electrolyte will be selected to assure that the composition does not form a gel. Generally, amounts of electrolyte salt of from about 0.05 to 2.0 wt %, preferably 0.1 to 1.5 wt %, especially preferably 0.25 to 1.4 wt %, will effectively prevent gelation from occurring.

As is generally understood, the role of the electrolyte to inhibit gelation can be explained based on the assumption that the invention dispersions of the cationic softening compounds have a vesicular structure. The spacing of the multilayered vesicles in the liquid crystalline phases varies with the electrolyte concentration since it depends on the repulsion between the head groups in adjacent layers. The amount of the enclosed water tends to be reduced at high salt concentrations, causing a lowering of the disperse phase volume and the viscosity. However, if one exceeds a critical concentration of the electrolyte, this may lead to a destabilization of the emulsions by flocculation or coalescence. The phenomenon of flocculation or coalescence can be explained by considering the electrostatic stabilization of colloidal dispersions. Attractive as well as repulsive forces act on the individual particles of a dispersion. The repulsive forces increase exponentially as the particles approach each other, such as when the concentration of dispersion increases, and they become very strong when the electrical double layers (the counterions in the dispersion medium give rise to the electrical double layers that surround the colloidal particles) that envelope each particle overlap. The thickness of the electrical double layers is very sensitive to the ionic strength of the dispersion medium. Increasing the ionic strength significantly diminishes the thickness of the double layer. The repulsive forces then become of insufficient magnitude and are no longer able to overcome the attractive van der Waals forces which may lead to dispersion flocculation or coagulation.

The compositions of the invention also contain a fatty alcohol ethoxylate nonionic surfactant to emulsify the perfume present in the composition. The presence of an emulsifier is required in accordance with the invention to insure the physical stability of the composition which would otherwise be destabilized by the presence of perfume or fragrance in the composition. The fatty alcohol ethoxylates useful in the invention correspond to ethylene oxide condensation products of higher fatty alcohols, with the higher fatty alcohol being of from about 9 to 15 carbon atoms and the number of ethylene oxide groups per mole being from about 5 to 30. In the preferred fatty alcohol ethoxylates for use herein, the alkyl chain length ranges from about 13 to 15 carbon atoms and the number of ethylene groups ranges from about 15 to 20 per mole. Especially preferred for use herein is Synperonic A20 manufactured by ICI Chemicals, such nonionic surfactant being an ethoxylated $C_{13}$–$C_{15}$ fatty alcohol with 20 moles of ethylene oxide per mole of alcohol.

In general, the HLB of the nonionic fatty alcohol ethoxylates are from about 12 to 20, with an HLB range of from about 14 to 16 being preferred. They are used in the composition in sufficient amount to provide emulsification, typically from about 1 to 5%, by weight of the composition.

As used herein, the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes), the essential oils themselves being volatile odoriferous compounds and also serving to dissovle the other components of the perfume.

In the present invention, the particular composition of the perfume is of no importance with regard to the performance of the liquid fabric softener composition so long as it meets the criteria of water immiscibility and having a pleasing odor.

The compositions of the invention further contain a polyethylene glycol polymer or polyethylene glycol alkyl ether polymer as a rheology modifier which serves to prevent gelation of the super-concentrated liquid compositions. The polyethylene glycol polymers useful herein have a molecular weight of at least 200 up to a molecular weight of about 8,000. Useful polymers include the polyethylene glycol and polyethylene glycol methyl ether polymers marketed by Aldrich Chemical Company. Useful amounts of polymer in the composition range from about 0.1% to about 5%, by weight. A range of from about 0.5 to about 1.5%, by weight, is preferred.

An optional ingredient in the invention compositions is a second rheology modifier to help reduce or eliminate variations in the aqueous dispersion viscosity over time. It should be understood, however, that so long as the viscosity does not increase to an unacceptably high level over the expected life of the produce (including transportation from the manufacturing plant to the market place, shelf-life in the market place, and duration of consumption by the end user) a second rheology modifier is not necessary. For example, the viscosity after, for instance, 8 to 10 weeks, should preferably not exceed about 1500 cP (at 25° C.), especially preferably the viscosity should not exceed about 1500 cP (at 25° C.) over the expected lifetime of the product. In many cases, initial viscosities of up to about 1,200 cP can be achieved and maintained.

Examples of optional rheology modifiers for use herein are well known in the art and may be chosen from, for example, polymeric rheology modifiers and inorganic rheology modifiers. Examples of the former type include polyquaternium compounds, such as Polyquaternium-24 (a hydrophobically modified polymeric quaternary ammonium salt hydroxyethyl-cellulose, available from Amercho, Inc.); cationic polymers such as copolymers of acrylamide and quaternary ammonium acrylate; the Carbopols, and the like. Generally, only minor amounts, up to about 1.0%, preferably up to about 0.8%, such as, for example, 0.01 to 0.60 percent, by weight, provide acceptable viscosity levels over time.

Another additive which has been found to be useful as a rheology modifier is citric acid, generally in amounts of from about 0.05 to 1.0 wt %, preferably from about 0.1 to 0.6 weight percent. Fatty alcohols and non-ionic surfactants may also be included in minor amounts (e.g. up to about 5% by weight, preferably up to about 2% by weight) as viscosity modifiers and/or emulsifying agents.

Other optional components commonly used in fabric softening compositions may be added in minor amounts to enhance either the appearance or performance properties of the liquid fabric softener compositions of this invention. Typical components of this type include, but are not limited to colorants, e.g., dyes or pigments, bluing agents, preservatives, germicides, and perfumes.

The subject liquid fabric softener compositions may be prepared by adding the active ingredients, usually as a melt, to the heated aqueous phase to which the acid component has been pre-mixed, under mixing. Low-shear mixing is generally sufficient to adequately and uniformly disperse the active ingredients in an throughout the aqueous phase. Further particles size reduction can be obtained by subjecting the composition to further treatment such as in a colloid mill or by high pressure homogenization, however, as previously noted, no significant improvement in softening performance has been associated with such particle size reduction.

The final product, whether in concentrated or diluted form must be easily pourable by the end user. Generally, therefore, final product viscosity (for a freshly prepared sample) should not exceed about 1500 centipoise, preferably not more than 1000 centipoise, but should not be too low, for example not less than about 50 centipoise. The preferred viscosity for the invention concentrated product is in the range of 120 to 1000 centipoise. As used herein, unless otherwise specified, viscosity is measured at 25° C. (22°–26° C.) using a Brookfield RVTD Digital Viscometer with Spindle #2 at 50 rpm.

The concentrated compositions may be diluted by a factor of generally 4:1 or more, preferably up to about 10:1 or even 10 to 12:1. Concentrated products with up to about 40 weight percent of softeners may be prepared and will remain pourable and stable against phase separation or suspended particle agglomeration for extended periods of time. The concentrated products of this invention provide equivalent softness at the same use level (e.g., about 110 ml for standard washing machine) as a (hypothetical) softener product containing up to about 50 weight percent or more of ditallow dimethyl ammonium chloride (DTDMAC). For example, a composition with about 28% of softeners can be diluted to about 5% actives to provide equivalent or superior softening performance to a product containing about 7% of DTDMAC. After dilution, or for a ready-to-use product, the composition will normally contain sufficient softener to be effective when added to the rinse water in an amount of about one-eighth to three-quarters of a cup (1 to 6 ounces) providing about 50 ppm to about 250 ppm of softener in the rinse water.

In the above description and in the following examples and claims all parts and percentages are given on a weight basis unless otherwise stated.

EXAMPLE 1

This example demonstrates the effect of concentration of the active softening components (A) and (B) on the viscosity of the softener composition for compositions formulated in accordance with U.S. Pat. No. 5,501,806 to Farooq et al. and which are outside the present invention. A mixture of Varisoft-510 and Varisoft-511 described above were used in a weight ratio of 75/25 (Varisoft 510/Varisoft-511) as component (A) in the composition. Component (B) was the diester quaternary compound (DEQ) Tetranyl AT-75 from Kao Corporation, Japan, designated as methyl triethanolamine-tallow diester quaternary ammonium methyl sulfate. The alkyl hydrocarbon groups in DEQ are based on about 75% soft tallow and 25% hard tallow. Accordingly, based on soft tallow containing about 45% unsaturated alkyl chains this DEQ product contains about 34% of unsaturated alkyl chains (45/100×75). The formulations shown in Table 1 below contain component (A) (amidoamine) and component (B) (DEQ) in a weight ratio of (A) to (B) of 1.67 to 1, resulting in a composition containing about 20% of unsaturated hydrocarbon groups in components (A) and (B) combined.

The method of preparation was as follows:

Varisoft 510, Varisoft 511 and Tetranyl AT-75 were each melted, mixed together with stirring and maintained at 70° C., the total amounts of active components in Compositions 1–5 being shown in Table 1. Perfume (Douscent 653, from IFF) was added to the respective molten mixtures. Separately, HCl (in the amounts shown in Table 1) was added to heated (70° C.) deionized water. The mixture of molten softening active compounds was added to the acidified water phase with stirring using a 4-pitched-blade impeller. During addition of the molten mixture the stirring speed was increased from 300 to 700 rpm as the emulsion thickened. Calcium chloride (0.4%, as 20% aqueous solution) was added to break or prevent gelation. The hot mixture was stirred for an additional 10 minutes at 350 the emulsion was allowed to cool to 30° C. at which time colorant (0.03%) and preservative (0.01%) were added.

Each of the compositions was measured for initial and the results are reported in Table 1 below.

TABLE 1

| Composition No. | HCL (Wt %) | Perfume (Wt %) | Total Actives [Wt % (A) + (B)] | Initial Viscosity[1] |
|---|---|---|---|---|
| 1 | — | — | 5 | 10–20 |
| 2 | 0.84 | 2.4 | 28 | 128 |
| 3 | 0.95 | 2.4 | 31.5 | 120 |
| 4 | 1.05 | 2.4 | 35 | 240 |
| 5 | 1.16 | 2.4 | 38.5 | Gel (greater than 8,000 cP) |

[1]Initial viscosity reading as measured with Brookfield Model DV-II viscometer, Spindle #2 50 rpm at room temperature.

The data in Table 1 demonstrates the inability of the prior art softening compositions of Farooq et al. which are based on amidoamine and esterquat to be concentrated beyond 35% by weight of active softening components because of gelation of the composition. It is this drawback in the prior art to which the present invention is addressed.

EXAMPLE 2

This example demonstrates that softening compositions which are otherwise formulated in accordance with the present invention except that the softening components (A) and (B) contain no unsaturated hydrocarbon groups (contrary to the requirement of the present invention), cannot be formulated as liquid compositions containing more than 35% by weight of active components because of the problem of gelation at higher concentrations.

Composition 6 shown in Table 2 was prepared using Varisoft-510 as amidoamine component (A), and Hipochem X-89107 from High Point Chemical Corp. as the diesterquat component (B) having 100% saturation in the tallow moieties. The method of preparation was in accordance with the invention whereby the oil phase portion containing (A) and (B) was heated to 70° C. and then mixed under agitation in a glass container with the water phase portion containing the PEG polymer and HCl resulting in a thick emulsion. Agitation was provided by a propeller stirrer having three 7 cm diameter blades on a shaft of 35 cm length and 8 mm diameter using an IKA stirring motor (RW 20 DZM). To the thick emulsion, there was added electrolyte ($CaCl_2$) under agitation to form a thin emulsion.

The perfume was emulsified with nonionic surfactant in 15 ml of water at about 70° C. and this mixture then added under agitation to the thin emulsion noted above. The preservative and optionally a desired colorant was then finally added. A gel having a viscosity greater than 10,000 cP was formed.

TABLE 2

| Component | Composition 6 (Wt %) | Initial Viscosity |
|---|---|---|
| Varisoft-510[1] | 23.45 | Gel (above 10,000 cP) |
| Diesterquat[2] (85% active) | 14. 05 | |
| PEG 750 (25% active)[3] | 1.0 | |
| 10% HCl | 1.16 | |
| 25% Calcium Chloride | 0.55 | |
| Emulsifier[4] | 0.5 | |
| Preservative | 0.01 | |
| Perfume | 2.4 | |
| Water | Balance | |

[1]Hydrogenated tallow amidoamine marketed by Witco Chemical Company.
[2]Hipochem x-89107 marketed by High Point Chemical Company.
[3]Polyethylene glycol methyl ether polymer having a molecular weight of 750 purchased from Aldrich Chemical Company.
[4]$C_{13}$–$C_{15}$ fatty alcohol EO 20:1.

EXAMPLE 3

This example demonstrates that compositions in accordance with the invention can be prepared at concentrations above 35%, by weight, of active materials, yet remain readily pourable and provide efficaceous softening.

Control composition "C" was prepared as shown below based on an amidoamine amine (A) and diesterquat (B) softening system containing 37.5% of actives along with fragrance and fatty alcohol ethoxylate nonionic emulsifier but in the absence of a polyethylene glycol polymer, and hence, outside the present invention. The method of preparation was in accordance with the method of the invention except for the absence of a PEG polymer in the water phase; the water phase being added to the heated oil or organic phase containing the melted softening components. A thick emulsion was formed. The method of preparation is thereafter as described in Example 2 wherein electrolyte ($CaCl_2$) was added under agitation to the thick emulsion to form a thin emulsion, followed by the addition of water containing the emulsified perfume.

| Component | Composition C (Wt %) Containing 37.5% Actives | Initial Viscosity |
|---|---|---|
| Varisoft 510 (A) | 17.59 | The viscosity readings during repetitive preparations varied from 1,200 cP to about 8,000 cP and were highly unreproducable. |
| Varisoft 511[1] (A) | 5.86 | |
| Diesterquaternary Compound (DEQ)[2] (B) | 14.05 | |
| HCl | 1.16 | |
| $CaCl_2$ | 0.55 | |
| Dye | 0.03 | |
| Perfume[3] | 2.4 | |
| Emulsifier[4] | 0.5 | |

[1]bis (tallow amido ethyl) hydroxyethyl (nominally 2 ethylene oxide groups per molecule) amine (from Witco Chemical Company) (45% unsaturated alkyl chains)
[2]Tetranyl AT-75 from Kao Corporation, described in Example 1
[3]Douscent-653 from IFF Corporation
[4]$C_{13}$–$C_{15}$ fatty alcohol, EO 20:1

A series of compositions in accordance with the invention were prepared by incorporating varying amounts of a polyethylene glycol polymer into a base composition similar to control composition C. The polymer was included in the water phase portion which was subsequently added to the heated organic phase as per the method of the invention. The viscosity of each composition was measured over a period of at least three weeks, and the results noted below in Table 3.

TABLE 3

The effect of polyethylene glycol polymer on the viscosity of a super-concentrated fabric softener containing 37.5 wt % of active material (Control Composition C Plus PEG)

| Wt % Polymer | Initial Viscosity[1] | Week - 1 | Week - 2 | Week - 3 |
|---|---|---|---|---|
| PEG-600[2] | | | | |
| 0.5 | 1210 | 1250 | 1110 | 1130 |
| 1.0 | 867 | 743 | 738 | 778 |
| 1.5 | 1600 | 1410 | 1220 | 1260 |
| PEG-750[3] | | | | |
| 0.5 | 1060 | 917 | — | 982 |
| 1.0 | 1400 | 1110 | — | 1150 |
| 1.5 | 1750 | 1630 | — | 1790 |

[1]Viscosity measurements were made with Brookfield Model DV-II Viscometer, spindle #2, 50 rpm at room temperature.
[2]Polyethylene glycol having a molecular weight of 600 purchased from Aldrich Chemical Company.
[3]Polyethylene glycol methyl ether polymer having a molecular weight of 750 purchased from Aldrich Chemical Company.

As noted in Table 3, the compositions of the invention are readily pourable and manifest a stable viscosity below 2,000 cP.

The softening efficacy of control composition C was measured and compared to that of the composition of Table 3 containing 1% of PEG-600 polymer. Composition C provided a softening efficacy of about 50 EQ as compared to about 55 EQ for the composition of the invention containing PEG polymer.

The measurement of softening efficacy in terms of EQ units is based on a comparison with ditallow dimethyl ammonium chloride (DTDMAC). The softening corresponding to 5% level of ditallow dimethylammonium chloride (DTDMAC) is referred to as 5EQ and at double dosage level (corresponding to 10% level of DTDMAC) is referred to as 10 EQ. If one plots a graph of softening versus the dosage amount of ditallow dimethylammonium chloride (a standard used for the softening evaluation), the softening increases linearly with the dosage of DTDMAC up to about 9–10% and then it levels off. This means, that for a dispersion of ditallow dimethylammonium chloride (say 5%) comparing the softening efficacy at 15% and 12% dosage levels, one cannot make a distinction in the softening performance. For example, to obtain a diluted composition with a softening efficacy of 10 EQ using a 34% dispersion, a comparison can be made with a 5% dispersion of DTDMAC. If "y" grams of the 5% DTDMAC product is used in the test to get a softening efficacy of 5 EQ, then ("y"×10/5) grams would be used to get 10 EQ softening efficacy. The amount of 34% dispersion needed would be equal to [5/34 ("y")] grams. So in general the EQ ratings are obtained at low concentration levels. The softening performance values correlating to a value of for example 50 EQ for the undiluted composition is based on the assumption of linear effect for the amount of softening agent and softening performance.

EXAMPLE 4

This example compares the effect of preparing a super-concentrated liquid fabric softening composition based on amidoamine (A) and diesterquat (B) using the method of the invention versus a method of preparation which is similar thereto but not in accordance with the invention.

A liquid fabric softening composition containing 37.5% of active components was prepared in accordance with the method of the invention as follows:

The composition is described below as composition E.

Composition E Containing 37.5% Actives

| Component | Weight % |
|---|---|
| Varisoft 510 (A) | 17.59 |
| Varisoft 511[1] (A) | 5.9 |
| Diesterquaternary Compound (DEQ)[2] (B) | 14.05 |
| HCl | 1.16 |
| $CaCl_2$ | 0.55 |
| Dye[3] | 0.03 |
| Perfume[4] | 2.4 |
| Emulsifier[5] | 0.5 |
| PEG 750[6] | 1.0 |
| Water | Balance |

[1]bis (tallow amido ethyl) hydroxyethyl (nominally 2 ethylene oxide groups per molecule) amine (from Witco Chemical Company) (45% unsaturated alkyl chains).
[2]Tetranyl AT-75 from Kao Corporation, designated as methyl triethanolamine-tallow diester quaternary ammonium methyl sulfate.
[3]Blue Liquitint ® dye
[4]Douscent-653 from IFF Corporation
[5]$C_{13}$–$C_{15}$ fatty alcohol, EO 20:1 (Synperonic A20)
[6]refer to description of PEG 750 in Example 3, Table 3.

The method of preparation was as follows:

Varisoft 510 and Varisoft 511 as component (A) and the diesterquat Tetranyl AT-73 as component (B) were each melted and mixed together to form the oil phase portion. The weight ratio of component (A) to component (B) was 1.67 to 1. The oil phase was maintained at 70° C. and mixed under agitation in a 500 ml container with the water phase portion containing the PEG polymer and HCl. A thick emulsion was formed.

Agitation was provided by a propeller stirrer having three 7 cm diameter blades on a shaft of 35 cm length and 8 mm diameter using an IKA stirring motor (RW20DZM).

Electrolyte in the form of a 20% aqueous solution of $CaCl_2$ was added under agitation to the thick emulsion described above, forming a thin emulsion.

The perfume was emulsified with nonionic surfactant in 15 ml of water at about 70° C. and this mixture then added under agitation to the thin emulsion noted above. The resulting mixture was then stirred for an additional 10 minutes at 350 rpm and allowed to cool to 30° C. at which time the dye and optionally a preservative were then finally added.

A super-concentrated liquid having an initial viscosity of 1,400 cP was thus prepared.

In a comparative method of preparation not in accordance with the invention, the oil phase portion was prepared as described above but further containing the perfume component. The water phase portion was prepared as described above but further containing the nonionic surfactant emulsifier. The oil phase portion and water phase portion were then mixed and agitated as described above at a temperature of about 70° C. to form a thick emulsion.

An aqueous solution of $CaCl_2$ electrolyte was added to the above-described thick emulsion under agitation and the resulting mixture allowed to cool to 30° C., at which time the dye was finally added.

The resulting liquid softening composition had an initial viscosity of about 9,000 cP.

What is claimed is:

1. A concentrated, stable, pourable and water dispersible liquid fabric softener composition containing a perfume and having a viscosity of less than about 2,000 centipoise at 20° C. comprising an aqueous dispersion containing (a) more than 35%, by weight, of a combination of softening components (A) and (B) wherein (A) is an inorganic or organic acid salt of a fabric softening compound of formula (I):

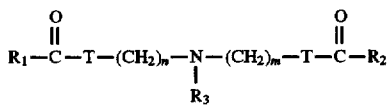

(I)

wherein $R_1$ and $R_2$ independently represent $C_{12}$ to $C_{30}$ aliphatic hydrocarbon groups, $R_3$ represents $(CH_2CH_2O)_pH$, $CH_3$ or H, T represents NH, n=1 to 5, m=1 to 5, and p=1 to 10; and (B) is a biodegradable fatty ester quaternary ammonium compound of formula (II):

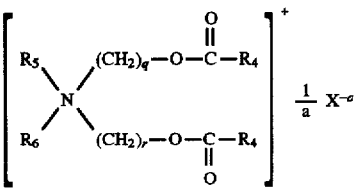

(II)

wherein each $R_4$ independently represents an aliphatic hydrocarbon group having from 8 to 22 carbon atoms, $R_5$ represents $(CH_2)_s$ $R_7$ where $R_7$ represents an alkoxy carbonyl group containing from 8 to 22 carbon atoms, benzyl, phenyl, $(C_1$–$C_4)$—alkyl substituted phenyl, OH or H; R6 represents $(CH_2)_t$ $R_8$ where $R_8$ represents benzyl, phenyl, $(C_1$–$C_4)$ alkyl substituted phenyl, OH or H;

q, r, s and t, each independently, represent a number of from 1 to 3; and x is an anion of valence a;

the weight ratio of component (A) to component (B) being from about 5:1 to about 1:5, and with the proviso that at least 15% of hydrocarbon groups containing two or more carbon atoms in components (A) and (B) combined contain at least one unsaturated carbon to carbon bond;

(b) an aqueous solvent including an anti-gelling effective amount of electrolyte;

(c) a fatty alcohol ethoxylate in an amount sufficient to emulsify the perfume in the composition; and (d) an effective amount of a polyethylene glycol polymer or a polyethylene glycol alkyl ether polymer having a molecular weight of at least about 200, said effective amount being sufficient to prevent gelation of the composition.

2. The composition of claim 1 wherein in the compound of formula (I) $R_1$ and $R_2$ are each independently $C_{16}$ to $C_{22}$ alkyl or alkenyl; m and n are integers from 1 to 3; and $R_3$ represents $(CH_2CH_2O)_pH$ wherein p is from 1.5 to 3.0.

3. The composition of claim 1 wherein at least 20% of hydrocarbon groups containing two or more carbon atoms in components (A) and (B) combined contain at least one unsaturated bond.

4. The composition of claim 3 wherein less than 70% of said hydrocarbon groups are unsaturated.

5. The composition of claim 1 wherein the total amount of components (A) and (B) is from above 35% to about 50%, by weight, of the fabric softening composition.

6. The composition of claim 5 wherein the total amount of components (A) and (B) is from above 35% to about 40%, by weight, of the composition.

7. The composition of claim 1 wherein the weight ratio of (A):(B) is from about 2:1 to 1:2.

8. The composition of claim 1 wherein the aqueous solvent comprises water and from about 0.05% up to about 2.0%, by weight, of an alkali metal or alkaline earth metal salt electrolyte.

9. The composition of claim 1 wherein component (A) is a mixture of salts of bis(tallowamidoethyl)-2-hydroxyethylamine) and bis(hydrogenated tallow amidoethyl)-2-hydroxyethyl amine; and component (B) is N-methyl-N,N,N-triethanolamine ditallowester quaternary ammonium methosulfate.

10. A method of imparting softness to fabrics comprising contacting the fabrics with an effective amount of the fabric softener composition of claim 1.

11. The method of claim 10 wherein said fabrics are contacted during the rinse cycle of an automatic laundry washing machine.

* * * * *